US005572224A

United States Patent [19]

Moller et al.

[11] Patent Number: 5,572,224

[45] Date of Patent: Nov. 5, 1996

[54] MULTIPLE WINDING WHIP ANTENNA ASSEMBLY FOR RADIO CIRCUIT AND METHOD THEREFOR

[75] Inventors: Paul J. Moller, Lake Zurich; Patrick A. Schwinghammer, Arlington Heights, both of Ill.

[73] Assignee: Motorola, Inc., Schaumburg, Ill.

[21] Appl. No.: 425,694

[22] Filed: Apr. 19, 1995

Related U.S. Application Data

[63] Continuation of Ser. No. 11,016, Jan. 29, 1993, abandoned.

[51] Int. Cl.[6] ..... H01Q 1/24

[52] U.S. Cl. ..... 343/702; 343/895; 343/725; 343/729

[58] Field of Search ..... 343/702, 713, 343/715, 729, 745, 749, 751, 752, 895, 900, 901, 903, 725; H01Q 1/24, 1/36

[56] References Cited

U.S. PATENT DOCUMENTS

| | | | |
|---|---|---|---|
| 4,121,218 | 10/1978 | Irwin et al. | 343/702 |
| 4,229,743 | 10/1980 | Vo et al. | 343/749 |
| 4,725,845 | 2/1988 | Phillips | 343/702 |
| 4,868,576 | 9/1989 | Johnson, Jr. | 343/702 |
| 5,057,849 | 10/1991 | Dörrie et al. | 343/749 |
| 5,177,492 | 1/1993 | Tomura et al. | 343/702 |
| 5,204,687 | 4/1993 | Elliott et al. | 343/702 |
| 5,258,765 | 11/1993 | Dörrie et al. | 343/749 |
| 5,353,036 | 10/1994 | Baldry | 343/702 |
| 5,374,937 | 12/1994 | Tsunekawa et al. | 343/702 |

FOREIGN PATENT DOCUMENTS

| | | | |
|---|---|---|---|
| 0359361A1 | 3/1990 | European Pat. Off. . | |
| 0467822A2 | 1/1992 | European Pat. Off. . | |
| 3919884 | 12/1990 | Germany | 343/895 |
| 3-186001 | 8/1991 | Japan . | |
| 2185635 | 7/1987 | United Kingdom . | |

*Primary Examiner*—Hoanganh Le
*Attorney, Agent, or Firm*—Randall S. Vaas

[57] ABSTRACT

A nondirectional antenna assembly, and associated method, for a radio operative at high frequencies, such as at frequencies of approximately 1.8 Gigahertz. A first antenna portion, formed of a one-half wavelength, helical winding is supported at a distal side of a nonconductive whip. A second antenna portion, comprised of a helical winding supported at a proximal side of the nonconductive whip, and a one-quarter wave helical winding, connected to radio circuitry of the radio transceiver, couples the first antenna portion to the radio circuitry. Because the first antenna portion is positioned at a distal side of the nonconductive whip, shadowing occurring as a result of positioning the radio transceiver proximate to a user during operation thereof is less likely to interfere with operation of the radio transceiver.

11 Claims, 4 Drawing Sheets

MULTIPLE WINDING WHIP ANTENNA ASSEMBLY FOR RADIO CIRCUIT AND METHOD THEREFOR

This is a continuation of application Ser. No. 08/011,016, filed Jan. 29, 1993 and now abandoned.

BACKGROUND OF THE INVENTION

The present invention relates generally to antenna assemblies and, more particularly, to an antenna assembly, and an associated method, for a portable radio operable to transmit or receive, or both transmit and receive, high-frequency, modulated signals.

A communication system is comprised, at a minimum, of a transmitter and a receiver interconnected by a transmission channel. A communication signal is transmitted upon the transmission channel, thereafter to be received by the receiver.

A radio communication system is a communication system in which the transmission channel comprises a radio frequency channel wherein the radio frequency channel is defined by a range of frequencies of the electromagnetic frequency spectrum. A transmitter operative in a radio communication system converts the communication signal to be transmitted into a form suitable for transmission thereof upon the radio frequency channel.

Conversion of the communication signal into the form suitable for the transmission thereof upon the radio frequency channel is effectuated by a process referred to as modulation. In such a process, the communication signal is impressed upon an electromagnetic wave. The electromagnetic wave is commonly referred to as a "carrier signal." The resultant signal, once modulated by the communication signal, is referred to as a modulated carrier signal, or, more simply, a modulated signal. The transmitter includes circuitry operative to perform such a modulation process.

Because the modulated signal may be transmitted through free space over large distances, radio communication systems are widely utilized to effectuate communication between a transmitter and a remotely-positioned receiver.

The receiver of the radio communication system which receives the modulated carrier signal contains circuitry analogous to, but operative in a manner reverse with that of, the circuitry of the transmitter and is operative to perform a process referred to as demodulation.

Numerous modulated carrier signals may be simultaneously transmitted as long as the signals are transmitted along differing radio frequency channels defined upon the electromagnetic frequency spectrum. Regulatory bodies have divided portions of the electromagnetic frequency spectrum into frequency bands and have regulated transmission of the modulated signals upon various ones of the frequency bands. The frequency bands are further divided into channels, and such channels form the radio frequency channels of a radio communication system. It is of course to be understood that separate channels may be defined over a single range of frequencies when signals are transmitted in a discontinuous manner, such as, e.g., in a time division multiple access (TDMA) communication scheme.

A two-way radio communication system is a radio communication system, similar to the radio communication system above-described, but which permits both transmission of a modulated signal from a location and reception at such location of a modulated signal. Each location of such a two-way communication system contains both a transmitter and a receiver. The transmitter and the receiver positioned together at the single location typically comprise a unit referred to as a radio transceiver or, more simply, a transceiver.

A cellular communication system is one type of two-way radio communication system and, when operative, communication is permitted with a radio transceiver positioned at any location within a geographic area encompassed by the cellular communication system.

A cellular communication system is created by positioning a plurality of fixed-site radio transceivers, referred to as base stations, at spaced-apart locations throughout a geographic area. The base stations are connected to a conventional, wireline, telephonic network. Associated with each base station of the plurality of base stations is a portion of the geographic area encompassed by the cellular communication system. Such portions are referred to as cells. Each of the plurality of cells is defined by one of the base stations of the plurality of base stations, and the plurality of cells together define the coverage area of the cellular communication system.

A radio transceiver, referred to in a cellular communication system as a cellular radiotelephone or, more simply, a cellular phone, positioned at any location within the coverage area of the cellular communication system, is able to communicate with a user of the conventional, wireline, telephonic network by way of a base station. Modulated signals generated by the radiotelephone are transmitted to a base station, and modulated signals generated by the base station are transmitted to the radiotelephone, thereby to effectuate two-way communication therebetween. (A signal received by a base station is then transmitted to a desired location of a conventional, wireline network by conventional telephony techniques. And, signals generated at a location of the wireline network are transmitted to a base station by conventional telephony techniques, thereafter to be transmitted to the radiotelephone by the base station.)

Certain designs of radio transceivers operable in cellular communication systems, as well as other radio communication systems, are of dimensions permitting their carriage by a user. Such portable radio transceivers are typically comprised of telephonic handsets which are somewhat analogous in appearance with telephonic handsets of conventional, telephonic apparatus. Namely, such portable transceivers include speaker portions and microphone portions supported in the handsets at spaced distances permitting a user thereof simultaneously to listen to signals transmitted to the transceiver and to generate signals therefrom.

The transceiver circuitry of a portable transceiver is housed within a transceiver housing body defining the dimensions of the handset and, typically, a single antenna is coupled to such transceiver circuitry. The antenna typically extends at a height (i.e., elevation) beyond the transceiver housing body to permit emanation of modulated signals generated during operation of the radio transceiver and to permit reception of modulated signals transmitted thereto.

The antenna utilized for such a portable radio transceiver is usually designed to form a nondirectional antenna as the user of the portable radio transceiver may position the transceiver in almost any orientation relative to a remote site (in a cellular communication system, such remote site comprises a base station) to which, or from which, modulated signals are transmitted during operation of the transceiver. That is to say, the user of the portable radio transceiver may operate the transceiver when the transceiver is positioned in either a direction directed away or a direction directed towards, or in any direction therebetween, relative to the remote site.

For best reception, such antennas are further usually of lengths substantially corresponding to fractional wavelengths of signals to be received by, or transmitted from, the antenna. More particularly, the lengths of such antennas are typically of either one-half or one-quarter wavelengths of such signals.

With respect to cellular communication systems, existing systems are operable in a frequency band having frequencies in the upper-hundreds of Megahertz. For instance, in the United States, a frequency band comprised of selected radio frequency channels between 800 Megahertz and 900 Megahertz are assigned for use by cellular communications systems. The magnitudes of one-half and one-quarter wavelengths of signals transmitted at such frequencies are of lengths of approximately seventeen and nine centimeters, respectively (or approximately seven and three inches, respectively).

A one-half wavelength antenna of such a length extending beyond a portable radio transceiver housing body also extends a distance beyond the body of a user when the user positions the transceiver for operation thereof. Hence, shadowing caused by the body of a user does not significantly interfere with transmission or reception of signals by such an antenna which extends beyond the transceiver housing body by a distance approaching—configuring the antenna in the form of the helix somewhat reduces the height at which the antenna so-formed extends beyond the housing body—seventeen centimeters (or seven inches). (The term shadowing is used to describe absorption of modulated signals by an object, usually positioned proximate to an antenna, which prevents desired reception by the antenna or transmission to a remote site, of a modulated signal. When an antenna, here an antenna affixed to a radio transceiver, is positioned proximate to an individual, the individual causes shadowing, the effect of which interferes with signal propagation to and from the antenna.)

Newly-proposed radio communication systems are to be operable at much higher frequencies—namely, in the 1.8 Gigahertz (GHz) range. Such a frequency range is more than twice as great as the just-mentioned 800–900 Megahertz range at which existing, cellular communication systems in the United States are operable.

At such increased frequencies, the lengths of one-half and one-quarter wavelength antennas forming portions of radio transceivers operable at such increased frequencies are of lengths less than one-half of the lengths of corresponding antennas of lengths of one-half and one-quarter wavelengths operable in radio transceivers of the existing, cellular communication systems. (For instance, an antenna of a length of a one-half wavelength of a 1.8 Gigahertz signal is of a length of approximately eight and one third centimeters or three and one quarter inches.) Antennas of such lengths extending beyond radio transceiver bodies do not extend for distances great enough to avoid significant shadowing effects by the body of a user when operating a radio transceiver to transmit or to receive modulated signals of such frequencies.

What is needed, therefore, is an antenna assembly for a radio transceiver operable to transmit or to receive signals at such increased frequencies which may be positioned to extend beyond the radio transceiver a distance great enough so that shadowing does not significantly affect operation of the radio.

SUMMARY OF THE INVENTION

The present invention, accordingly, advantageously provides a nondirectional antenna assembly for a radio having radio circuitry housed within a radio body.

The present invention further advantageously provides an antenna assembly for a radio which may be positioned to extend therebeyond a distance great enough so that shadowing caused by a user does not significantly affect operation of the radio.

The present invention yet further provides a radiotelephone having an antenna assembly which may be positioned to extend beyond a transceiver housing body a distance great enough so that shadowing caused by a user thereof does not significantly affect operation of the transceiver.

The present invention yet further provides a method for positioning a nondirectional antenna beyond a radio housing body having radio circuitry housed therewithin.

The present invention includes further advantages and features, the details of which will become more readily apparent when reading the detailed description of the preferred embodiments hereinbelow.

In accordance with the present invention, an antenna assembly, and associated method, for a radio having radio circuitry housed within a radio housing body is disclosed. A whip has a proximal side portion and a distal side portion and is positionable to permit extension of at least the distal side portion thereof beyond the radio housing body. A first antenna portion is positioned at the distal side portion of the whip and is positionable in unison with the whip. And, a second antenna portion has at least a first side section thereof positioned at the whip and is coupled to the first antenna portion. A second side section of the second antenna portion is coupled to the radio circuitry housed within the radio housing body, thereby to couple the first antenna portion with the radio circuitry.

BRIEF DESCRIPTION OF THE DRAWINGS

The present invention will be better understood when read in light of the accompanying drawings in which.

DESCRIPTION OF THE PREFERRED EMBODIMENTS

As mentioned hereinabove, portable radio transceiver, are typically comprised of radio transceiver circuitry housed within a radio transceiver body and an antenna structure, coupled to the radio transceiver circuitry, which extends beyond the radio transceiver body. The antenna structures of such radio transceivers are typically of lengths substantially corresponding to fractional wavelengths, such as one-half wavelengths, of the modulated signals to be transmitted and received by the radio transceivers. And, such antenna structures extend to heights beyond the transceiver bodies of the radio transceivers approaching such lengths. (As noted previously, when an antenna is configured in the form of a helix, its height is somewhat less than a when the antenna is configured of a straight length of wire.)

Radiotelephones comprising the radio transceivers operative in most existing, cellular communication systems are operative to transmit and to receive modulated signals of frequencies between 800 and 900 Megahertz, or thereabouts. Antenna structures of lengths of one-half wavelengths of such signals are of lengths of approximately seventeen centimeters (or seven inches).

When a user of such a radiotelephone having an antenna of a length of the one-half wavelength fully extends the antenna beyond the radiotelephone housing, at least a portion of the antenna is likely to be positioned beyond the user during operation of the radiotelephone. (More particularly, analogous to positioning of a handset of conventional, telephonic apparatus during operation thereof by a user, the portable radiotelephone is positioned alongside the face of the user.) As the antenna extends beyond the radiotelephone by a length approaching seventeen centimeters, shadowing effects caused by the user normally do not significantly impair operation of the radiotelephone.

However, as also mentioned hereinabove, newly-proposed communication systems are to be operative in the frequency range of 1.8 Gigahertz. Fractional wavelength antennas of lengths of one-half wavelengths of radio transceivers operable at such frequencies are of lengths of approximately eight and one third centimeters (or three and one quarter inches).

When a user of a radiotelephone operable at such an increased frequency fully extends a one-half wavelength antenna beyond the housing of the radiotelephone, the antenna extends beyond the housing only by a length approaching the length defined by the fractional (one-half) wavelength of the increased-frequency at which the radiotelephone is operable. Hence, the antenna is significantly more likely to be susceptible to the effects of shadowing caused by a user when the radiotelephone is positioned proximate to the user during operation thereof.

Figure 1:
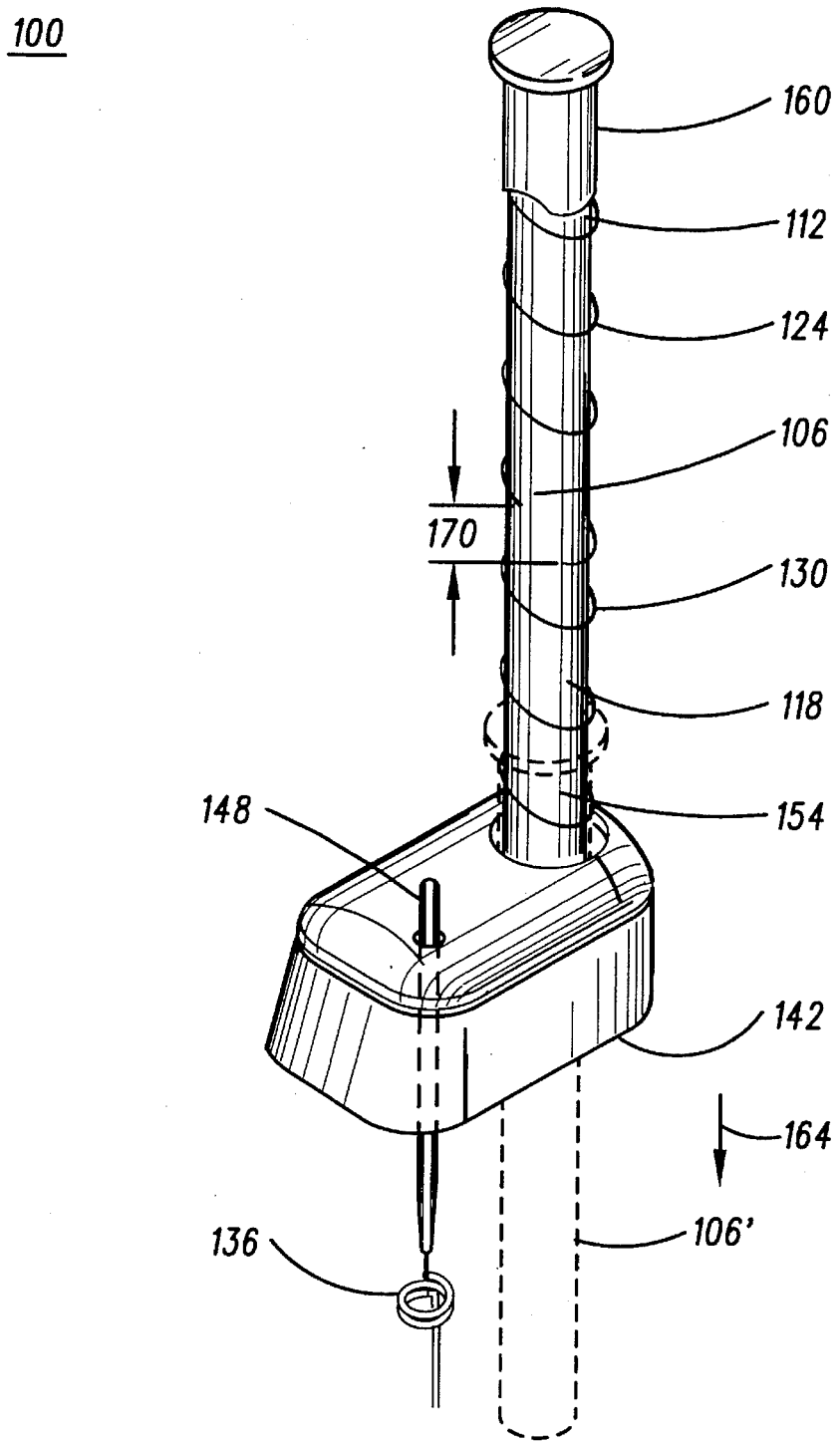
FIG. 1 is an isolational view of the antenna assembly of a preferred embodiment of the present invention.

Turning now first to the isolational view of FIG. 1, the antenna assembly, referred to generally by reference numeral 100, of a preferred embodiment of the present invention which is operable at the high frequencies of operation (including, for example, the just-mentioned 1.8 Gigahertz frequency) is shown. Antenna assembly 100 overcomes the problems associated with existing art antennas when the radiotelephones of which the antennas form portions are constructed to be operable at the increased frequencies. Substantial portions of an active portion of antenna assembly 100 may be positioned to extend beyond a radio transceiver housing of a radio transceiver to permit reception and transmission of high-frequency, modulated signals thereat.

Antenna assembly 100 comprises a nonconductive whip 106 which functions here as a support member and, more generally, as a positioning member. Whip 106 is formed of a longitudinally-extending rod member formed of a thermoplastic material having a distal side portion 112 formed of a top portion of whip 106 and proximal side portion 118 formed of a bottom portion of whip 106. While in common parlance, a simple, monopole antenna formed, typically, of a metallic tube is oftentimes referred to as an "antenna whip," the term whip here shall refer to the nonconductive rod about which helical windings are supported.

A first antenna portion formed of helical winding 124 is wrapped about distal side portion 112 of whip 106. Helical winding 124, in the preferred embodiment, is of a length substantially corresponding to lengths of one-half the wavelengths of signals of frequencies corresponding to the frequencies at which a radio transceiver of which antenna assembly 100 is to form a portion is operable. The first antenna portion is formed of the helical winding primarily for production reasons as a wire may be easily wrapped about whip 106.

A second antenna portion of antenna assembly 100 comprises a first side section and a second side section. The first side section of the second antenna portion is formed of helical winding 130. Helical winding 130 is wound about proximal side portion 118 of whip 106. The first side section of the second antenna portion of assembly 100 is also formed of the helical winding primarily for production reasons. Similar to helical winding 124, in the preferred embodiment, helical winding 130 is also of a length substantially corresponding to lengths of one-half the wavelengths of signals of frequencies corresponding to the frequencies at which a radio transceiver of which assembly 100 is to form a portion is operable.

The second side section of second antenna portion of antenna assembly 100 is formed of helical winding 136 which is coupled to helical winding 130 by way of electrically-conductive, domed, cap member 142. A top end portion of helical winding 136 extends through aperture 148 and is soldered, or otherwise connected, to domed, cap member 142. A bottom end portion of helical winding 136 is coupled to transceiver circuitry of the radio transceiver (not shown in the figure) of which antenna assembly 100 forms a portion.

In the preferred embodiment, helical winding 136 is of a length substantially corresponding to lengths of one-quarter the wavelengths of signals of frequencies corresponding to the frequencies at which the transceiver of which antenna assembly 100 is to form a portion is operable. At such a length, helical winding 136 is of a feedpoint impedance of approximately fifty ohms. Such fifty ohm impedance matches the standard, characteristic impedance of most, conventional electronic circuitry.

Aperture 154 is also formed to extend through domed, cap member 142 and is of a diameter permitting insertion of nonconductive whip 106 therethrough.

Assembly 100 further includes sleeve member 160. While, for purposes of illustration, only a portion of sleeve member 160 is shown in the figure, such portion being positioned at distal side portion 112 of whip 106, in the preferred embodiment, sleeve member 160 extends along substantially the entire length of the longitudinally-extending rod member comprising whip 106. Sleeve member 160 is operative to provide a protective covering overtop windings 124 and 130.

The outside diameter of sleeve member 160 is of a magnitude substantially corresponding to an inside diameter of aperture 154. Aperture 154 thereby forms a supportive bushing which permits translation of nonconductive whip 106 in the direction of, and in the direction reverse to that of, arrow 164. As helical windings 124 and 130 are supported at distal and proximal side portions 112 and 118, respectively, of whip 106, such helical windings, and also sleeve member 160, are similarly translatable in unison with whip 106. Whip 106 may also be positioned at locations between fully-retracted and fully-extended antenna positions.

Shown in hatch, and represented by reference numeral 106', is the position of the nonconductive whip when fully translated in the direction indicated by arrow 160. Such position shall hereinafter be referred to as a retracted antenna position, as contrasted to the primary illustration of the figure which shall hereinafter be referred to as the extended antenna position.

Helical windings 124 and 130 supported about opposing side portions of nonconductive whip 106 are separated by gap 170, indicated by the arrow shown in the figure. Helical windings 124 and 130 are thereby capacitively coupled theretogether with the magnitude of the capacitive coupling, at least in part, determined by the length of gap 170.

Helical winding 130 of the first side section of the second antenna portion of antenna assembly 100 and domed cap member 142 of the second side section of the second antenna portion of antenna assembly 100 are thereby also capacitively coupled theretogether as sleeve member 160, which extends along the length of the longitudinally-extending rod comprising whip 106, covers helical winding 130 and thereby physically separates domed cap member 142 and helical winding 130.

Because of such couplings, helical winding 124 is electrically coupled to radio circuitry (not shown in the figure) which is connected to the bottom end portion of helical winding 136. Helical windings 130 and 136 and domed, cap member 142 thereby together function to couple helical winding 124 to the radio circuitry of the transceiver of which antenna assembly 100 forms a portion while permitting positioning of helical winding 124 at the distal side portion 112 of whip 106.

Figure 2:
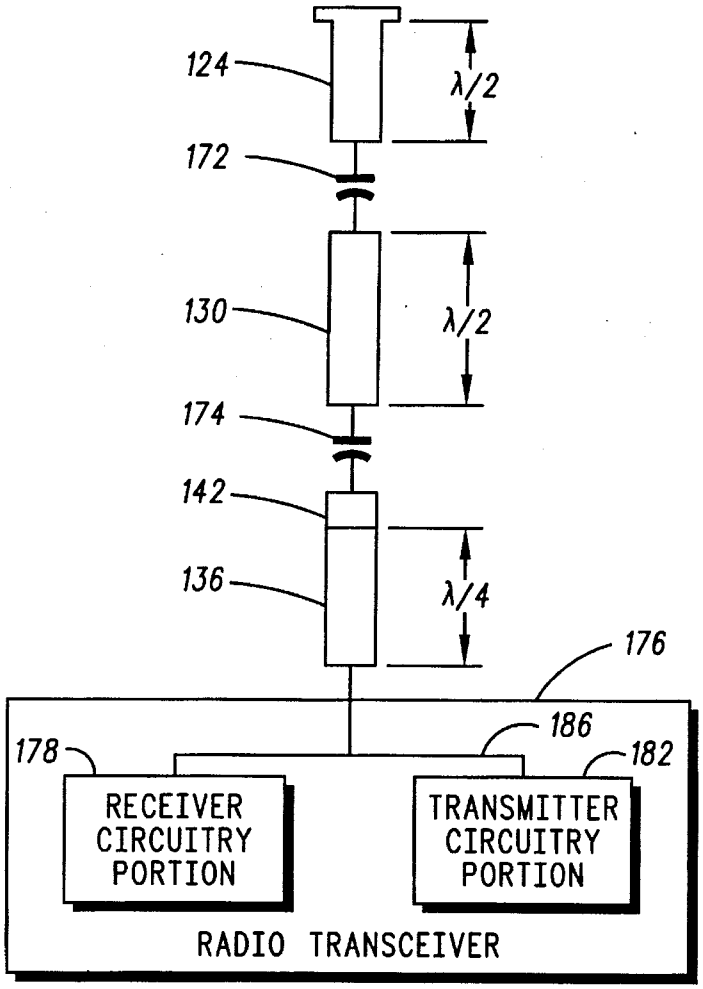
FIG. 2 is a partial block, partial schematic diagram of the antenna assembly of FIG. 1 positioned to extend beyond a radio transceiver.

FIG. 2 is a partial block, partial schematic diagram of antenna assembly 100, shown in isolation in FIG. 1. The view of FIG. 2 further shows antenna assembly 100 in connection with radio transceiver circuitry 176 which is comprised of receiver circuitry portion 178 and transmitter circuitry portion 182.

Helical windings 124, 130, and 136, and domed, cap member 142 are represented by blocks in the figure. Windings 124 and 130 are tandemly-positioned in the same arrangement as shown in the isolational view of FIG. 1. Helical windings 124 and 130 are capacitively coupled, indicated by capacitor 172 in FIG. 2, due to the physical separation between the windings 124 and 130. Helical winding 130 and domed, cap member 142 are also capacitively coupled theretogether, indicated by capacitor 174 in FIG. 2 due to the physical separation between the two elements 130 and 142 of a magnitude corresponding to the thickness of sleeve member 160. As, in the preferred embodiment, helical winding 136 and domed, cap member 142 are electrically connected theretogether, no gap separates winding 136 and cap member 142. The bottom end portion of helical winding 136 is electrically connected to the circuitry of radio transceiver 176, here shown to be comprised of receiver circuitry portion 178 and transmitter circuitry portion 182 by way of line 186. Windings 130 and 136, and cap member 142 together function to couple remotely-positioned winding 124 to the circuitry of radio transceiver 176.

As also mentioned previously, helical windings 124 and 130 are, in the preferred embodiment, of lengths substantially corresponding to lengths of one-half the wavelengths of signals of frequencies corresponding to the frequencies at which radio transceiver 176 is operable. And, in the preferred embodiment, helical winding 136 is of a length substantially corresponding to lengths of one-quarter the wavelengths of the signals of frequencies corresponding to the frequencies at which radio transceiver 176 is operable. Because of such relative lengths, windings 124 and 130 are of high impedance values, and helical winding 136 is of the feedpoint impedance of approximately fifty ohms (which, again, matches the impedance of radio transceiver 176, typically designed to be of a characteristic impedance of fifty ohms).

It should be noted that, because windings 130 and 136, and cap member 142 are operative to couple winding 124 to the circuitry of transceiver 176, such structure may be substituted, in other embodiments, by other elements. For instance, such structure may be substituted, in another embodiment, by a shortened, half-wave antenna winding, or a full one-quarter wavelength antenna winding, or a less-than-one-quarter wavelength stub or winding.

When radio transceiver 176 is operative at frequencies of approximately 1.8 Gigahertz, windings 124 and 130 of the lengths of the one-half wavelengths, are approximately eight and one third centimeters (three and one quarter inches) in length, respectively. And, winding 136 is of a length of approximately four and one quarter centimeters (one and five eighths inches). Because windings 124 and 130 are positioned in tandem, a top end of helical winding 124 extends close to seventeen centimeters (six and one half inches) beyond a bottom end portion of helical winding 130.

Figure 3:
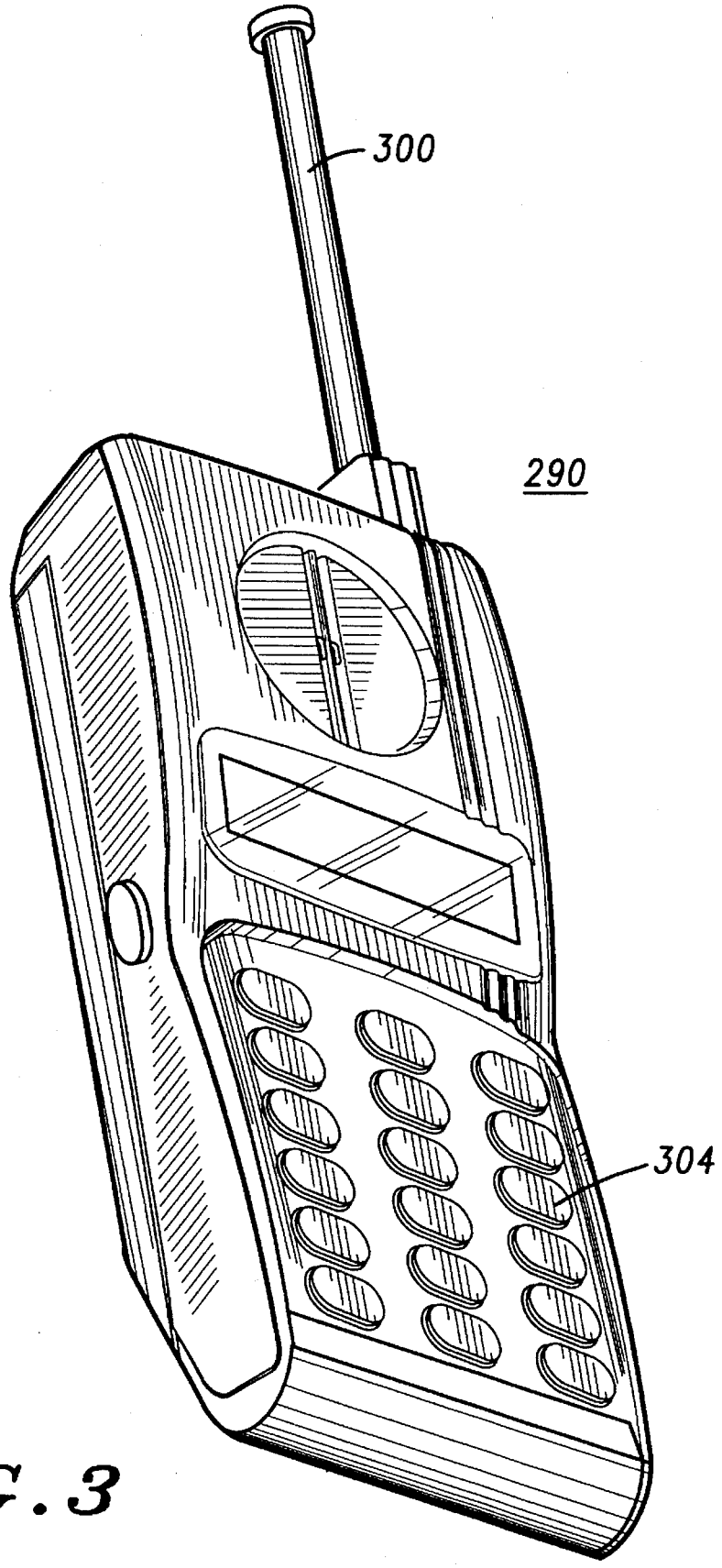
FIG. 3 is an perspective view of a radiotelephone of a preferred embodiment of the present invention which incorporates the antenna assembly of the preceding figures as a portion thereof.

Turning next to the isometric view of FIG. 3, a radiotelephone, referred to generally by reference numeral 290, of a preferred embodiment of the present invention is shown. Radiotelephone 290 includes an antenna assembly, here referred to by reference numeral 300 as a portion thereof. Antenna assembly 300 corresponds to antenna assembly 100 of the preceding figures. Radio circuitry corresponding to radio transceiver circuitry 174 of the preceding figure, is housed within radiotelephone housing body 304 to be supported therewithin. Antenna assembly 300, shown in the extended antenna position, extends beyond a top surface of radiotelephone housing body 304. When operative to receive signals of wavelengths corresponding to frequencies of approximately 1.8 Gigahertz, and when antenna assembly 300 is positioned in the extended antenna position, antenna assembly 300 extends beyond a top surface of radiotelephone housing body 304 by a distance of approximately seventeen centimeters (six and one half inches).

Figure 4:
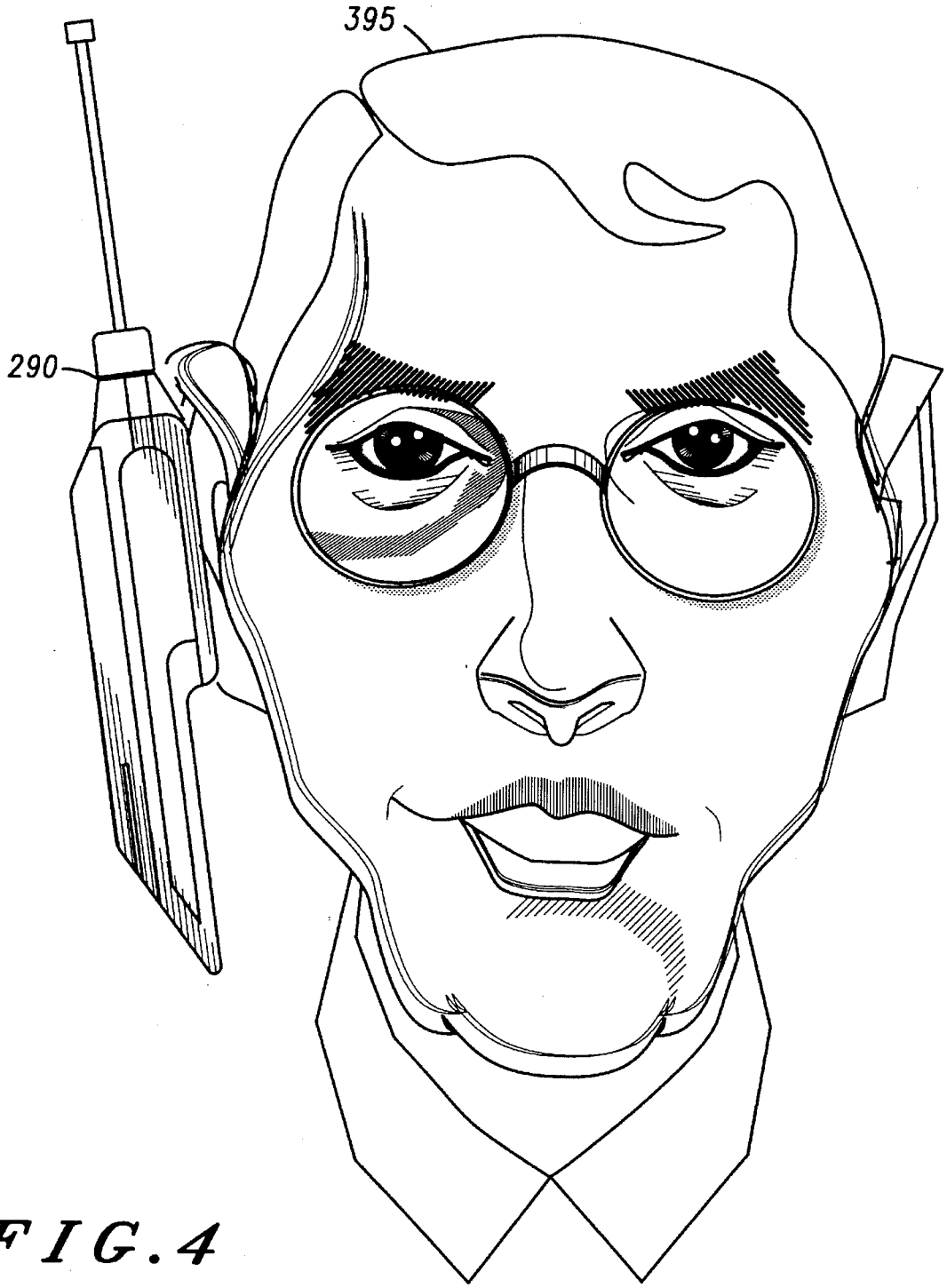
FIG. 4 is a view of the radio transceiver of FIG. 3 positioned proximate to a user during operation thereof.

Turning next to FIG. 4, radiotelephone 290 of FIG. 3 is again shown, but, here, radiotelephone 290 is positioned alongside the face of user 395, corresponding to the conventional positioning of the radiotelephone during operation thereof. Positioned as illustrated, user 395 is able simultaneously to listen to signals transmitted to the radiotelephone 290 and also to speak into radiotelephone 290.

Because the first antenna portion (comprised of helical winding 124 in the preceding figures) is positioned at a distal side portion of a longitudinally-extending rod forming a portion of antenna assembly 300, which extends a distance approaching almost seventeen centimeters (six and one half inches) beyond a top surface of radiotelephone housing body 304, at least a portion of antenna assembly 300 is likely not to suffer the effects of shadowing caused by user 395. Accordingly, use of antenna assembly 300 permits advantageous use of radiotelephone 290 even when the radiotelephone is operative at frequencies of approximately 1.8 Gigahertz. As the winding forming the first antenna portion of antenna assembly 300 forms a nondirectional antenna which is coupled to transceiver circuitry housed within radiotelephone housing body 304, user 395 may be positioned in any orientation relative to a remote site and signals generated by radiotelephone 290 or transmitted thereto, are transmitted or received by antenna assembly 300.

Figure 5:
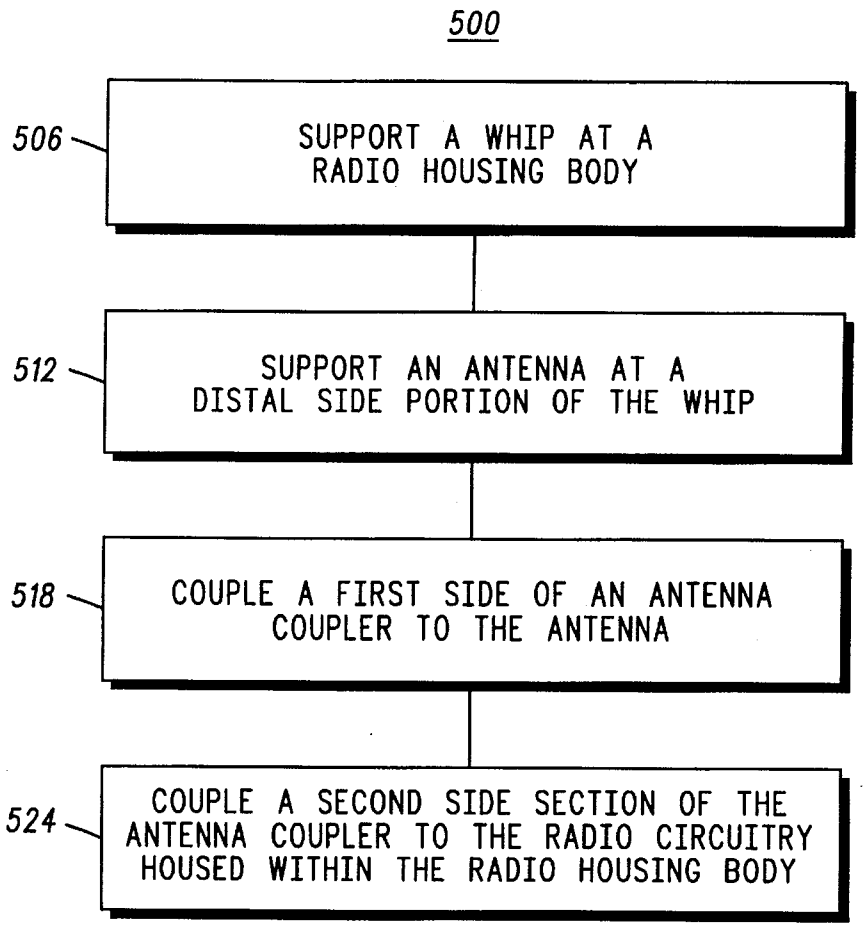
FIG. 5 is a logical flow diagram listing the method steps of the method of a preferred embodiment of the present invention.

Turning finally now to the logical flow diagram of FIG. 5, the method steps of the method, referred to generally by reference numeral 500, of a preferred embodiment of the present invention are listed. Method 500 is operative to position an antenna beyond a radio housing body having radio circuitry housed therewithin while permitting operative engagement of the nondirectional antenna with the radio circuitry.

First, and as indicated by block 506, a whip having a proximal side portion and a distal side portion is supported at the radio housing body. At least the distal side portion of the whip extends beyond the radio housing body.

Next, and as indicated by block 512, the antenna is supported at the distal side portion of the whip.

Next, and as indicated by block 518, a first side section of an 10 antenna coupler is coupled to the antenna supported at the whip.

Finally, and as indicated by block 524, a second side section of the antenna coupler is coupled to the radio circuitry housed within the radio housing body. The antenna is thereby coupled to the radio circuitry to couple thereby the antenna in operative engagement with the radio circuitry.

While the present invention has been described in connection with the preferred embodiments shown in the various figures, it is to be understood that other similar embodiments may be used and modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. A radio frequency communication device comprising:

a housing body;

radio circuitry housed within the housing body;

a whip movingly carried on the housing body such that the whip moves between an extended and a retracted position, the whip having a proximal end, to be positioned at the housing body when the whip is supported thereon, and a distal end to be spaced from the housing body when the whip is supported thereon, the proximal and distal ends being opposite ends of the whip, the whip projecting outwardly from the housing body when the proximal end is supported thereon;

a first antenna winding mounted on the whip and extending from the proximal end toward the distal end and terminating at a location between the proximal and distal ends, the first antenna winding having a proximal end for coupling to the radio circuitry within the housing body; and a second antenna winding mounted on the whip and extending from the distal end toward the proximal end of the whip, the second antenna winding terminating at a location between the proximal end and the distal end, the lengths of the first and second windings such that the first and second windings are capacitively coupled but are not connected, whereby the first and second windings are carried on the whip to move with the whip and the second winding is coupled to the radio circuitry within the housing body via the first winding when the whip is extended to space the second winding from the housing body when the whip is extended to reduce shadowing effect of a user of the radio telephone.

2. The communication device of claim 1 wherein the first antenna winding comprises a helical coil.

3. The communication device of claim 2 wherein the second antenna winding comprises a helical coil.

4. The communication device of claim 1 wherein the first antenna winding is of a length substantially corresponding to lengths of one-half wavelengths of signals of frequencies at which the radio circuitry of the radio is operable.

5. The communication device of claim 1 wherein the second antenna winding is of a length substantially corresponding to lengths of one-half wavelengths of signals of frequencies at which the radio circuitry of the radio is operable.

6. The communication device according to claim 1, wherein the first antenna winding is capacitively coupled to a conductor in the telephone housing body, which conductor is coupled to the circuitry.

7. A radio telephone, comprising:

a radio housing body;

radio circuitry housed within a radio housing body; and an antenna assembly comprising:

a retractable whip supported in the radio telephone housing and having a proximal end, to be positioned at the radio housing body when the whip is supported thereon, and a distal end to be spaced form the radio housing body when the whip is supported thereon, the proximal and distal ends being opposite ends of the whip, the whip projecting outwardly from the radio body when the proximal end is supported thereon;

a first antenna winding mounted on the whip add extending from the proximal end toward the distal end and terminating at a location between the proximal and distal ends, the first antenna winding having a proximal end for coupling to the circuitry within the radio telephone housing; and a second antenna winding mounted on the whip and extending from the distal end toward the proximal end of the whip, the second antenna winding terminating at a location between the proximal end and the distal end, the lengths of the first and second windings such that the first and second windings are capacitively coupled but are not connected, whereby the first and second windings are carried on the whip to be retracted and extended with the whip, and the second winding is coupled to the circuitry within the housing via the first winding and the second winding is spaced from the radio housing body by the first winding to reduce shadowing effect of a user of the radio telephone.

8. The radio telephone of claim 7 wherein the first antenna winding comprises a helical coil.

9. The radio telephone of claim 8 wherein the second antenna winding comprises a helical coil.

10. The radio telephone of claim 7 wherein the first antenna winding is of a length substantially corresponding to lengths of one-half wavelengths of signals of frequencies at which the radio circuitry of the radio is operable.

11. The radio telephone of claim 10 wherein the second antenna winding is of a length substantially corresponding to lengths of one-half wavelengths of signals of frequencies at which the radio circuitry of the radio is operable.

* * * * *